US011293724B2

(12) United States Patent
Hoemann et al.

(10) Patent No.: US 11,293,724 B2
(45) Date of Patent: Apr. 5, 2022

(54) MODULAR GUARD TOWERS AND METHODS OF CONSTRUCTION

(71) Applicant: United States of America as Represented by The Secretary of The Army, Alexandria, VA (US)

(72) Inventors: John M Hoemann, Vicksburg, MS (US); Justin M Roberts, Florence, MS (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 16/742,813

(22) Filed: Jan. 14, 2020

(65) Prior Publication Data

US 2021/0215461 A1 Jul. 15, 2021

(51) Int. Cl.

| | |
|---|---|
| ***F41H 5/24*** | (2006.01) |
| ***E04H 12/08*** | (2006.01) |
| ***E04H 12/12*** | (2006.01) |
| ***E04H 12/18*** | (2006.01) |
| ***E04B 1/343*** | (2006.01) |

(52) U.S. Cl.

CPC ..... *F41H 5/24* (2013.01); *E04B 1/34321* (2013.01); *E04H 12/08* (2013.01); *E04H 12/12* (2013.01); *E04H 12/18* (2013.01)

(58) Field of Classification Search

CPC ..... E04B 1/34321; E04H 12/08; E04H 12/12; E04H 12/18; E04H 3/08; F41H 5/24

USPC ..... 52/651.01, 2.21, 106

See application file for complete search history.

(56) References Cited

U.S. PATENT DOCUMENTS

| | | | | |
|---|---|---|---|---|
| 3,768,016 | A * | 10/1973 | Townsend | E04H 12/08 455/25 |
| 4,065,885 | A * | 1/1978 | Blick, III | E04H 1/1216 4/460 |
| 4,689,930 | A * | 9/1987 | Menchetti | E04B 2/7409 52/275 |
| 8,720,161 | B2 * | 5/2014 | Herrius de Roest | E04H 12/185 52/848 |
| 9,062,662 | B1 * | 6/2015 | Johnson | E04H 12/342 |
| 10,556,686 | B2 * | 2/2020 | Heidtmann | B64D 11/02 |

(Continued)

*Primary Examiner* — Brian E Glessner
*Assistant Examiner* — James J Buckle, Jr.
(74) *Attorney, Agent, or Firm* — Brian C. Jones

(57) ABSTRACT

Enclosed structures, such as guard towers, are provided which are designed to be easily transportable, constructed easily onsite and erected in a manner which produces an exceptionally blast resistant structure that is also advantageously designed for positioning within a perimeter wall. In particular, in some embodiments, the guard towers have a pentagon shape and are comprised of a plurality of composite panels. Each panel is able to be constructed onsite. The panels typically have a rectangular shape with at least one half of the panel constructed as a solid composite of concrete and metal. Once the panels are constructed, the panels are erected and arranged in a pentagon shape. The panels are bolted together with the use of vertical face connections. These connections provide better structural integrity, retained over time, particularly after subjection to a blast. In addition, the pentagon shape provides improved safety when positioned along a perimeter wall.

16 Claims, 8 Drawing Sheets

(56) References Cited

U.S. PATENT DOCUMENTS

| | | | | |
|---|---|---|---|---|
| 2004/0134162 | A1* | 7/2004 | Douglas | E04B 1/12 52/741.1 |
| 2005/0160697 | A1* | 7/2005 | Oliphant | E04H 12/02 52/843 |
| 2015/0292225 | A1* | 10/2015 | Gonda | E04C 2/34 52/630 |
| 2016/0017626 | A1* | 1/2016 | Argaman | E04H 9/10 52/123.1 |
| 2017/0145708 | A1* | 5/2017 | Chen | E04B 1/34384 |
| 2019/0170122 | A1* | 6/2019 | Longeru | E04H 12/12 |
| 2020/0309487 | A1* | 10/2020 | Paulson | F41H 5/24 |

* cited by examiner

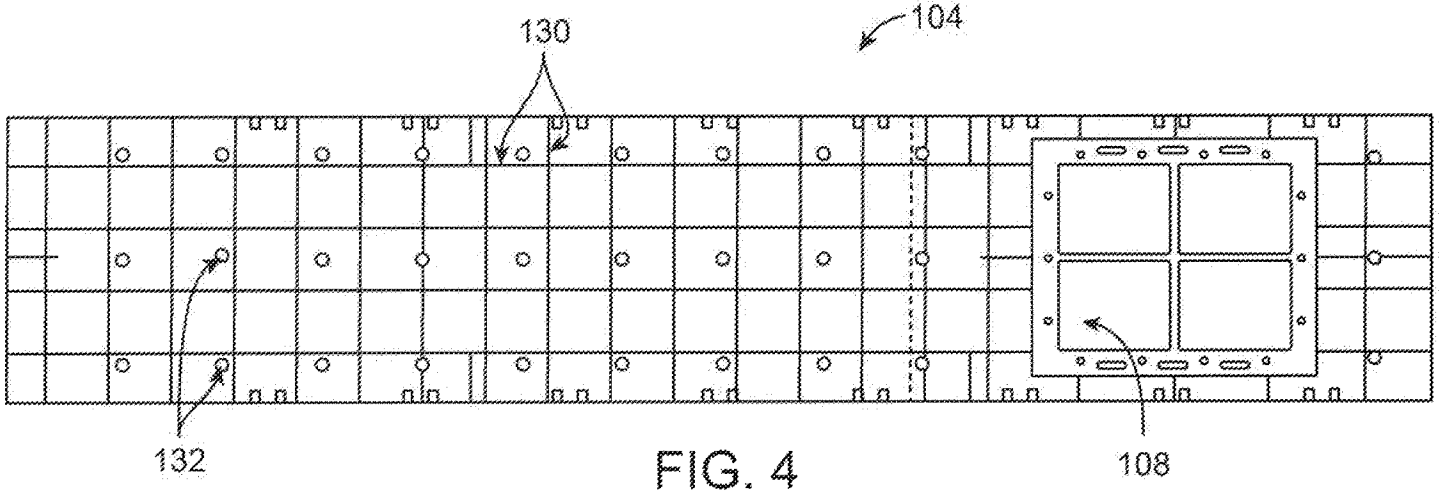
FIG. 4
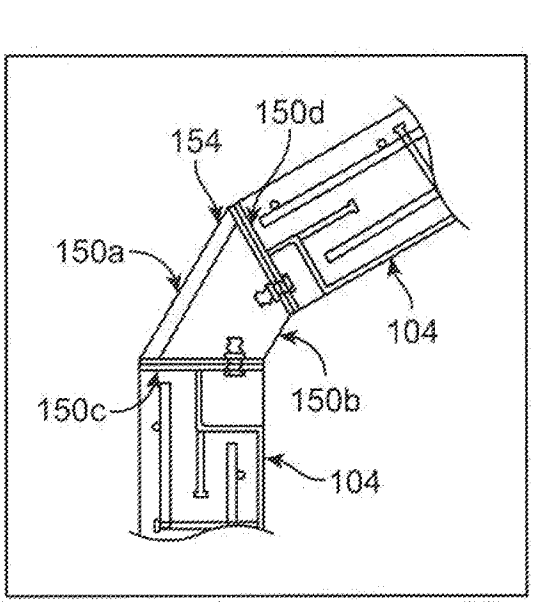
FIG. 5A
FIG. 5B
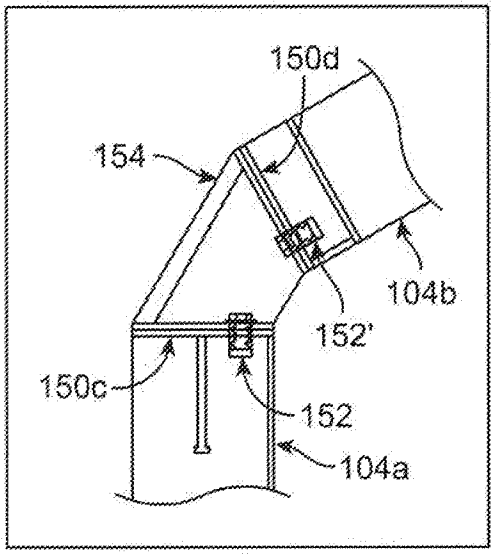
FIG. 5C

MODULAR GUARD TOWERS AND METHODS OF CONSTRUCTION

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to enclosed structures and, more particularly but not exclusively, to the design and construction of a modular guard tower that is blast resistant.

Description of the Related Art

This section introduces aspects that may help facilitate a better understanding of the invention. Accordingly, the statements of this section are to be read in this light and are not to be understood as admissions about what is prior art or what is not prior art.

A guard tower is traditionally considered to be any military tower used for guarding an area. These towers are usually operated by military personnel, and are often built in areas of established control. These include military bases and cities occupied by military forces. However, guard towers may also be found at various other industrial locations, such as correctional facilities, border crossings, airports, nuclear facilities, and chemical plants, to name a few.

Guard towers provide an elevated, secure platform from which to monitor activities around such facilities and protect personnel within the tower and compounds. Since most U.S. military installations and embassies are outside the continental United States (OCONUS), research has trended toward modular guard towers that are easy to construct, available from a designed kit, intended for cost efficient alternatives, and resistant to increased threat levels over commercial options. Attacks on U.S. military installations and diplomatic facilities have led to an increased focus on guard-tower design enhancements.

Although currently available modular guard tower systems provide valuable attributes in many instances, still further improvements are desirable, it is desired that such systems have improved visibility, blast resistance, transportability and constructability, to name a few. Embodiments of the present invention provide solutions to at least some of these outstanding needs.

SUMMARY

The present invention was developed to address the challenges described in the Background section. Additional research and further development has led to improved modular guard towers along with methods of construction.

The modular guard towers described herein were motivated by logistics, constructability and safety. Such guard towers are designed to be transportable in standard shipping containers, constructed easily onsite and erected in a manner which produces an exceptionally blast resistant structure that is also advantageously designed for positioning within a perimeter wall. In particular, in some embodiments, the guard towers have a pentagon shape and are comprised of a plurality of composite panels. Each panel is able to be constructed onsite and is comprised of a metal frame that arrives by shipping container and concrete that is poured into the metal frame onsite to generate the composite panel. The panels typically have a rectangular shape with at least one half of the panel constructed as a solid composite of concrete and metal. Often, a window is present and is positioned within the top half of the panel so that the base of the panel is solid and has superior blast resistance. Once the panels are constructed, the panels are erected and arranged in a pentagon shape. The panels are bolted together with the use of vertical face connections. These connections fasten metal to metal rather than concrete to concrete which provides better structural integrity, retained over time, particularly after subjection to a blast. These vertical face connections can withstand high shear forces that are created by a blast. The components of the guard tower become one structural element that is very difficult to topple over. In addition, the pentagon shape allows two panels of the guard tower to extend in a pointed configuration beyond a perimeter wall when the guard tower is positioned within the perimeter wall. When windows are disposed within these two panels, a line of sight is provided along the wall. This provides increased safety along with the increased protection provided by the stability of the structure.

BRIEF DESCRIPTION OF THE DRAWINGS

Embodiments of the invention will become more fully apparent from the following detailed description, the appended claims, and the accompanying drawings in which like reference numerals identify similar or identical elements.

FIG. 4 illustrates an embodiment of a panel prior to filling with concrete.

FIGS. 5A-5C illustrate example embodiments of vertical face connections which are used to connect the panels along the vertical edges.

DETAILED DESCRIPTION

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Improved modular guard towers are provided along with methods of construction. Such guard towers provide enhanced protection compared to readily available commercial towers. In particular, such guard towers provide improved visibility, blast resistance, transportability and constructability, to name a few.

Figure 1:
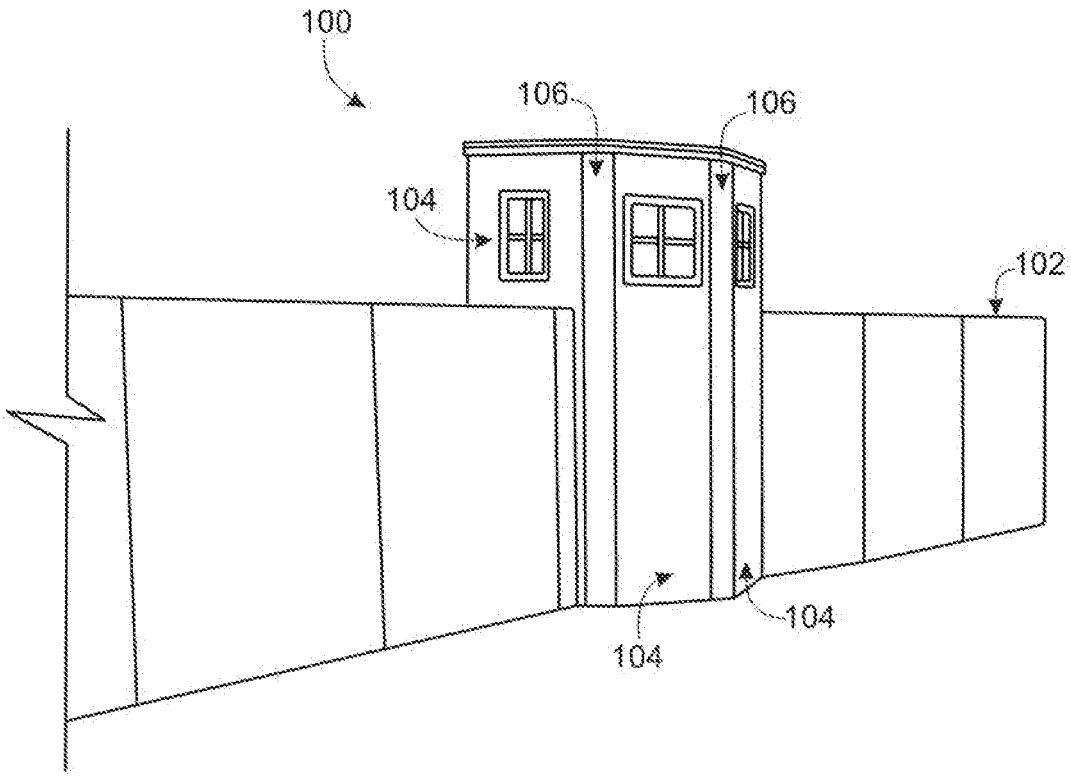
FIG. 1 illustrates an embodiment of a guard tower.

FIG. 1 illustrates an embodiment of a guard tower 100. In this embodiment, the guard tower 100 is designed to be part of a perimeter wall 102. Being part of a perimeter wall 102 is vital for securing the perimeter of a compound or guarded area. Typically, a complex attack involves personnel approaching the guarded area using the perimeter wall as cover. By incorporating the tower 100 into the perimeter wall 102, such approaching personnel are visible from the tower 100. In addition, the tower 100 is comprised of structures which form an upright pentagon (or multi-sided structure). The structures include five prefabricated panels 104 that are fastened or bolted together along vertical edges 106 to form the pentagon shape. In addition, at least some of the panels include windows 108. Thus, the "front" of the tower 100 has a two-sided shape that extends beyond the perimeter wall 102 rather than a flat face which would be in line with the perimeter wall 102. Typically, each of the panels 103 forming the two-sided shape has a window 108. The angle of these windows 108 increases visibility down the exterior face of the perimeter wall 102. Thus, no blind spots that hinder observation are created. The five-sided, in-wall design facilitates 100% line-of-sight for both "offensive" and "defensive" aspects of surveillance and combat in connection with guard tower technology.

Figure 2:
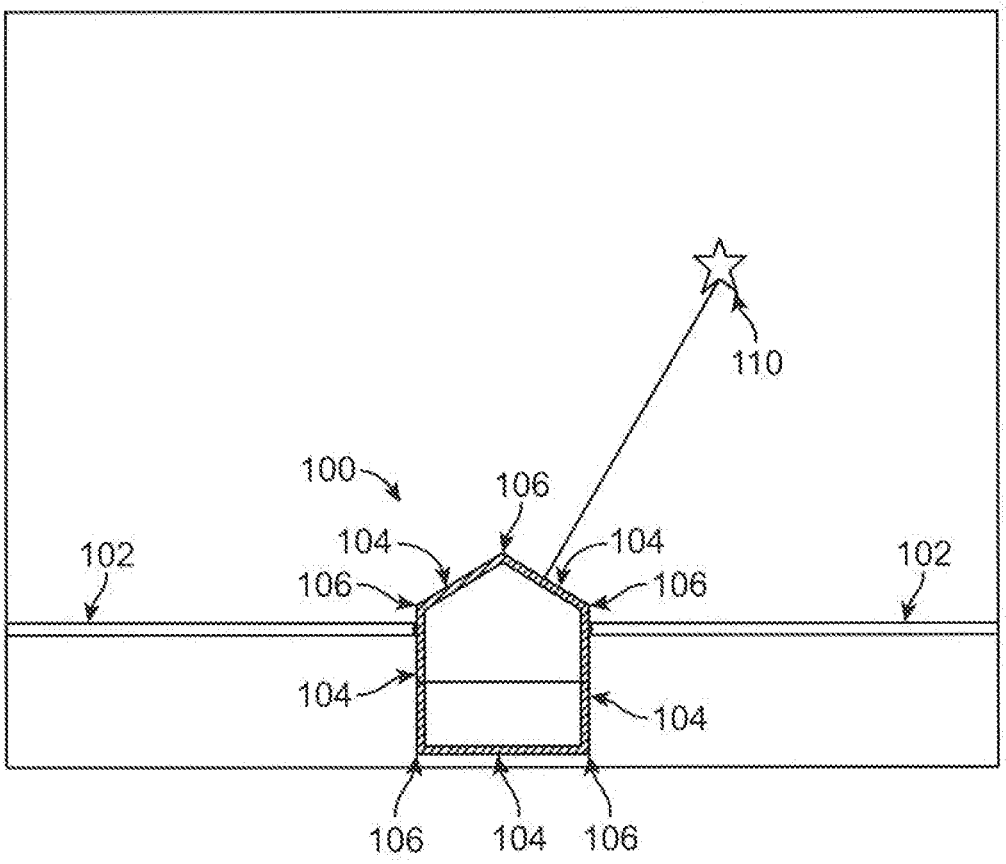
FIG. 2 provides a schematic top view of the guard tower and perimeter wall of FIG. 1.

FIG. 2 provides a schematic top view of the guard tower 100 and perimeter wall 102 of FIG. 1. Here, the pentagon shape can be visualized along with an example of its placement along the perimeter wall 102. Thus, the two-sided shape extends beyond the perimeter wall 102 providing visibility along the perimeter wall 102. The two-sided shape also creates narrower or angled reflecting surfaces, depending on charge placement, for a blast wave. The highest blast load would be considered to be normal to the window surface having a source location indicated by star 110. It may be appreciated that the window strength is sufficient to withstand such off axis blast loads.

The guard towers 100 are modular and designed to be assembled onsite using limited skilled labor. The panels 104 are comprised of pre-formed steel structures that are later filled with concrete onsite at the end location. Thus, the steel structures can be shipped in standard ISO containers to the desired end location. Using closed ISO containers provides visual concealment. When staging construction materials at a location or port of entry, visual access is blocked as to planned renovations. Hiding the materials leaves outsiders watching from afar, guessing on pending routine changes.

When constructing the guard tower 100, the steel structures are removed from the ISO container, at or near the desired site of construction. The panels are then filled with concrete to form composite steel/concrete panels. The resulting composite panels have the tolerances of the prefabricated steel member. This gives an advantage of prefabricated forms that are in a "kit" which is easily transportable, particularly in contrast to large precast concrete parts. The final composite panels are then vertically positioned on a pentagon-shaped foundation using a tilt-up method which is both cost effective and relatively easy for a structure of this size. The panels 104 are connected along the vertical edges 106 making the entire system operate as one large unitary structural tube. In some embodiments, the guard tower 100 can be deconstructed and the components can be placed into a shipping container for transport. Thus, the guard towers 100 have high portability and low logistics burden.

Figure 3A:
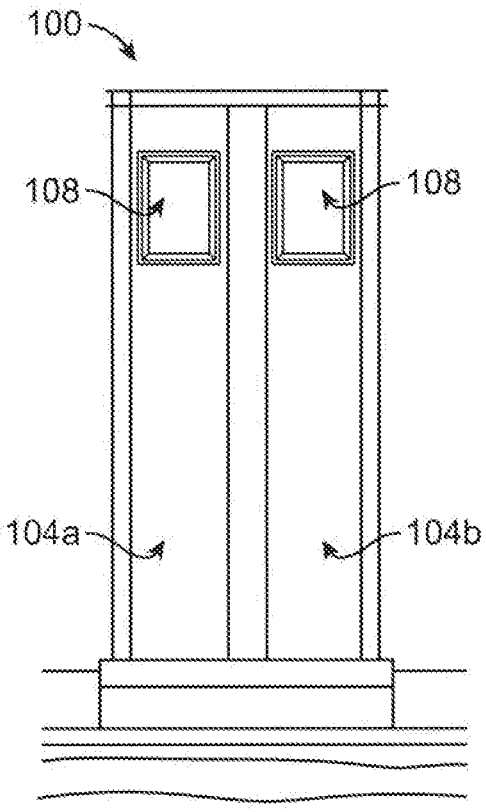
FIGS. 3A-3D illustrate various views of an embodiment of a guard tower.
Figure 3B:
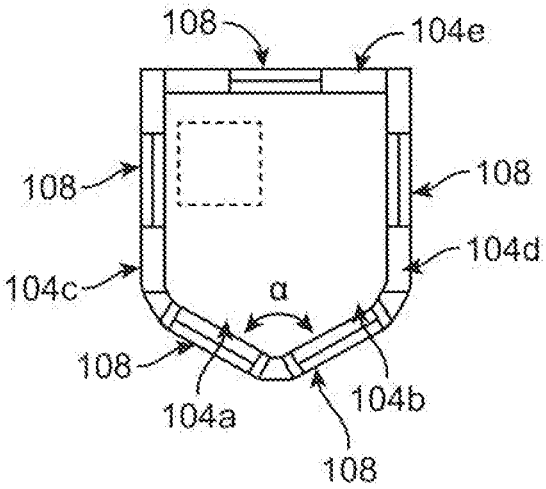
Figure 3C:
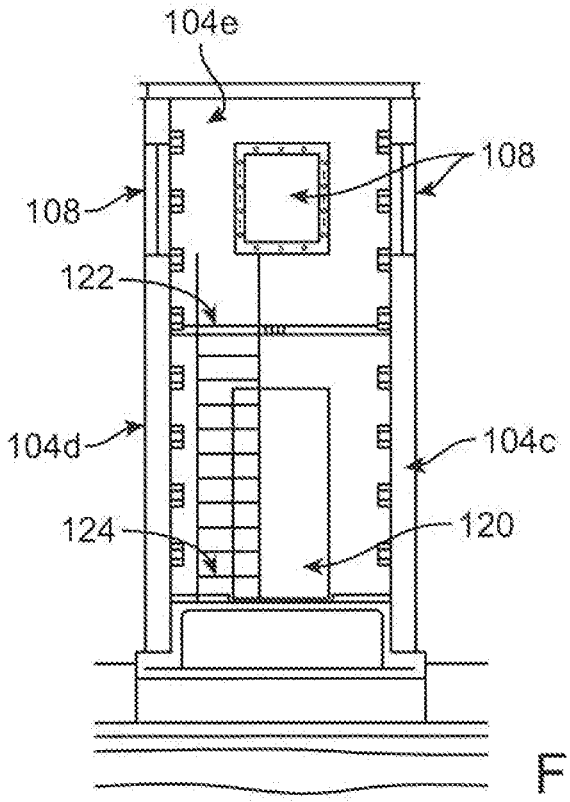
Figure 3D:
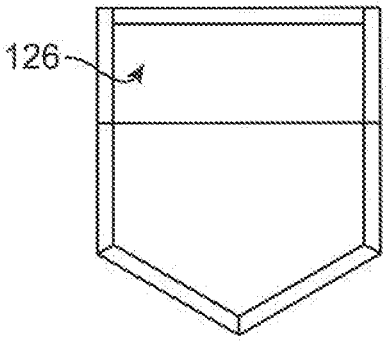

FIGS. 3A-3D illustrate various views of an embodiment of a guard tower 100. FIG. 3A provides a front view of the guard tower 100. As mentioned previously, the front of the guard tower 100 has a two-sided shape that typically extends beyond the perimeter wall 102 rather than a flat face which would be in line with the perimeter wall 102. Thus, the two-sided shape includes a first panel 104*a* and a second panel 104*b* that are positioned at an angle $\alpha$ to each other, such as an angle $\alpha$ in the range of 108-120 degrees. Additionally, three more panels, a third panel 104*c*, a fourth panel 104*d* and a fifth panel 104*e*, complete the pentagon shape of the structure, as illustrated in FIG. 38 which provides a cross-sectional view of the guard tower 100. As shown, in this embodiment, each of the panels 104*a*, 104*b*, 104*c*, 104*d*, 104*e*, includes a window 108. Typically, the windows are positioned within the top half of the guard tower 100 so as to provide superior visibility and to allow a continuous base which reduces vulnerability of the structure, such as in the event of a blast. FIG. 3C illustrates the back of the guard tower 100. In this embodiment, the back of the guard tower 100 or fifth panel 104*e* includes a door 120 below the window 108. Likewise, FIG. 3C illustrates the presence of an intermediate floor 122 within the guard tower 100 upon which people can stand, particularly for viewing out of the raised windows 108. The intermediate floor 122 can be reached by, for example, internal stairs or a ladder 124. FIG. 3D provides a top view of the guard tower 100, particularly the roof 126. In this embodiment, the roof 126 has a hexagonal shape coordinating with the shape of the guard tower 100. It may be appreciated that an architectural roof can be added on top of the roof 126 to act as a sun block and hide any mechanical units. Such an architectural roof can provide pre-detonation standoff for any indirect fire that might occur. It may be appreciated that the substructure supports and roof panels may become debris in a blast event. A balance of securing the components for environmental loading are considered with the reality that all components are frangible in a blast event. The lighter-massed blocking layer and frame are typically allowed to break apart and not impact structures behind the tower 100. Sun-blocking materials that could also serve as pre-detonation layers are preferred.

Panels

As mentioned previously, the panels 104 are comprised of pre-formed steel structures that are later filled with concrete onsite at the end location. Thus, the steel structures are shippable in standard ISO containers to the desired end location. Thus, the panels are configured to fit within the maximum weight and height limits for a standard 20-ft ISO container. Typically, panel thickness is not to exceed 10 in. The panels 104 are also compatible with DoS FE/BR standards. It may be appreciated that in some embodiments the guard tower 100 is as tall as 39 feet and can fit in a 40 foot container.

In embodiments meeting the standard 20-ft ISO container shipping requirement, the two front walls (i.e. the first panel 104*a* and the second panel 104*b*) are designed to be 19 ft tall by 3 ft 10 in. wide by 10 in. thick, including the steel spall liner. Further, in this embodiment, the side and rear walls (i.e. the third panel 104*c*, fourth panel 104*d*, fifth panel 104*e*) are designed to be 19 ft tall by 7 ft 6 in. wide by 10 in. thick. In this embodiment, all five panels include second-floor window openings. In some embodiments, the window openings are at least 8 feet from the base so as to create a continuous panel that has superior blast resistance. Also in this embodiment, the rear panel includes a door opening. In some embodiments, the desired nominal dimensions of a 3070 door opening is 30 in. wide and 70 in. high FIG. 4 illustrates an embodiment of a panel 104 prior to filling with concrete. In this embodiment, the panel 104 includes a pre-formed steel structure comprised of steel reinforcing bars 130 (i.e. Rebar). The Rebar 130 provides strength to the panel 104 and also helps the keep the form "square" when pouring the concrete. Here, A706 #6 Rebar 130 are spaced at 10" o.c, in each direction. Typically, the shorter bars are placed first with the longer vertical bars placed on top. In some embodiments, studs 132 (e.g. Nelson concrete anchors) are spaced 16" o.c, in each direction. The studs 132 come from the back plate so that when the entire panel 104 is raised, the panel 104 stays together. The studs 132 also help keep the panel flat.

As mentioned previously, each panel 104 is then filled with concrete. In some embodiments, a minimum fc is 3,000-psi concrete. In some embodiments, concrete and lifting hardware comply with the Current Version of the ACI 318 Requirements for Structural Concrete and the PCI Design Handbook. It may be appreciated that a contractor should take care to minimize leakage of concrete out of the pre-formed steel structure. In some instances it is recommend that the steel structure is caulked between welds and around Ferrules. The pre-formed steel structure should be clean of loose debris prior to casting.

Windows

In some embodiments, each window 108 has a height of 3 ft 4.75 inches and a width of 2 ft 9.25 inches. In some embodiments, the window 108 has dimensions of 39.25 in. high×31.75 in. wide with tolerances of −0, +0.125 in. on both.

In some embodiments, at least one window 108 is fixed closed. In other embodiments, at least one window 108 is openable, such as to swing open. In some embodiments, a window 108 can be opened post event, lay down cover fire, and prevent attackers from any breach in the perimeter wall.

In some embodiments, the windows 108 are glazed. In such embodiments, glazing is achieved with glass-clad polycarbonate with certified NIJ Level IV performance. In some embodiments, the glazing dimensions are 39.25 in. high×31.75 in. wide with tolerances of −0, +0.125 in. on both dimensions. In some embodiments, the glazing thickness is 2.25 in. It may be appreciated that glazing thickness may range from 2.13-2.50 in. and the frame assembly may be adjusted for various thicknesses based on availability.

Vertical Edges

As mentioned previously, the prefabricated panels 104 are fastened or bolted together along vertical edges 106 to form the overall pentagon shape of the guard tower 100. Such vertical attachment creates a very sturdy structure as the components become one structural element. With this design, the panels 104 do not slip out or away from each other horizontally, such as when exposed to a blast.

FIGS. 5A-5C illustrate example embodiments of vertical face connections which are used to connect the panels 104 along the vertical edges 106. FIG. 5A illustrates a vertical face connection comprising two vertical tubes 150 which are fastened together along their flat surfaces with a fastener 152 (e.g. a bolt). To reduce springing effect, the tubes 150 were replaced with a pocket connector 154 in FIGS. 5B-5C. As shown, the pocket connector 154 has a partial trapezoid shape having three sides wherein the "fourth side" of the trapezoid shape is missing or open. In some embodiments, the pocket connector 154 has a vertical length matching the vertical length of the panels 104. The pocket connector 154 is configured to have an external side 150*a* which faces outwardly from the guard tower 100 and is the visible vertical edge 106. An internal side 150*b* is the missing or open "fourth side" and is opposite and parallel to the external side 150*b*. Two connection sides 150*c*, 150*d* extend from the external side 150*a* toward the internal side 150*b* forming the trapezoid shape. The connection sides 150*c*, 150*d* interface with the panels 104, connecting the panels 104 together. For example, as illustrated in FIG. 5C, a first panel 104*a* is attached to connection side 150*c* by a fastener 152 and a second panel 104*b* is attached to connection side 150*d* by another fastener 152'. This holds the panels 104*a*, 104*b* in sturdy, vertical connection to each other. The panels 104*a*, 104*b* are fixedly held in this arrangement due to the stability of the pocket connection. It may also be appreciated that the portion of the panel 104 interfacing with the pocket connection 154 is an edge side 155 of the steel frame of the panel 104. Thus, the steel-to steel bolting provides better structural integrity than concrete to concrete bolting. Likewise, such bolting is retained over time, particularly after being subjected to a blast.

Figure 6:
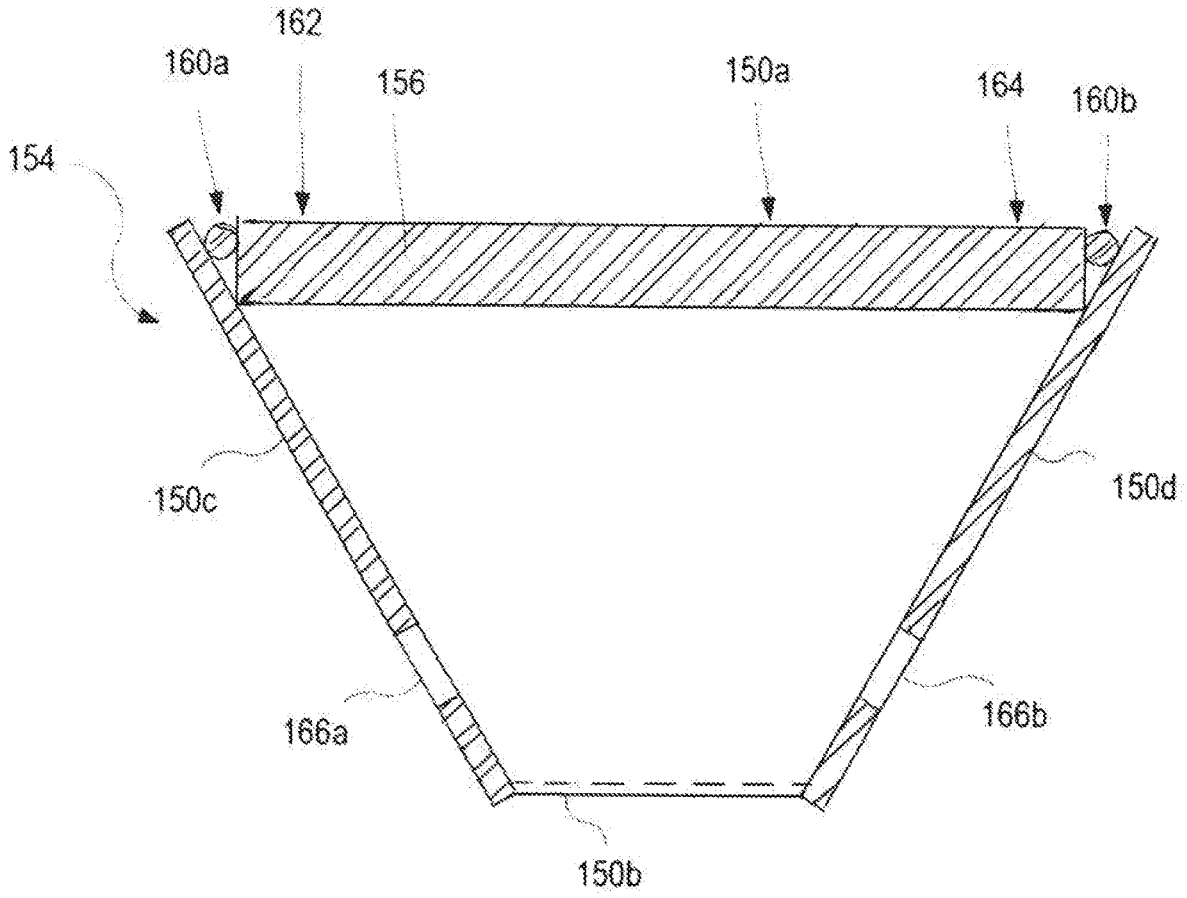
FIG. 6 provides a further illustration of an embodiment of a pocket connector.

FIG. 6 provides a further illustration of an embodiment of a pocket connector 154. In this embodiment, each of the connection sides 150*c*, 150*d* are approximately 10 inches wide. Likewise, the external side 150*a* is approximately 1 ft 3 inches wide and comprises a plate 156 that is 1 ft 15/16 inches wide, a first rod 160*a* and a second rod 160*b*, wherein the first rod 160*a* is positioned between a first end 162 of the plate 156 and connection side 150*c* and the second rod 160*b* is positioned between a second end 164 of the plate 156 and connection side 150*d*. These rods 160*a*, 160*b* are fixed in place (e.g. by welding) and are considered back filler rods. Back filler rods assist in welding so as to not require so many passes of welding when fabricating the pocket connectors. This reduces the amount of welding material needed. In this embodiment, the plate 156 has a greater thickness than the connection sides 150*c*, 150*d*. In this embodiment, the pocket connector 154 includes a first hole 166*a* along connection side 150*c* and a second hole 166*b* along connection side 150*d*, the center of each hole 166*a*, 166*b* approximately 2 3/8 inches from the free end of the connection side 150*c*, 150*d* (i.e. nearest the internal side 150*b*). The first hole 166*a* and second hole 166*b* are configured to receive the fasteners to attach the pocket connector 154 to the respective panels 104. Further, in this embodiment, the internal side 150*b* is 5 inches wide. Thus, the internal side 150*b* is shorter than the external side 150*a*. Such a shape allows for the overall construction of the pentagon shaped tower 100.

Figure 7:
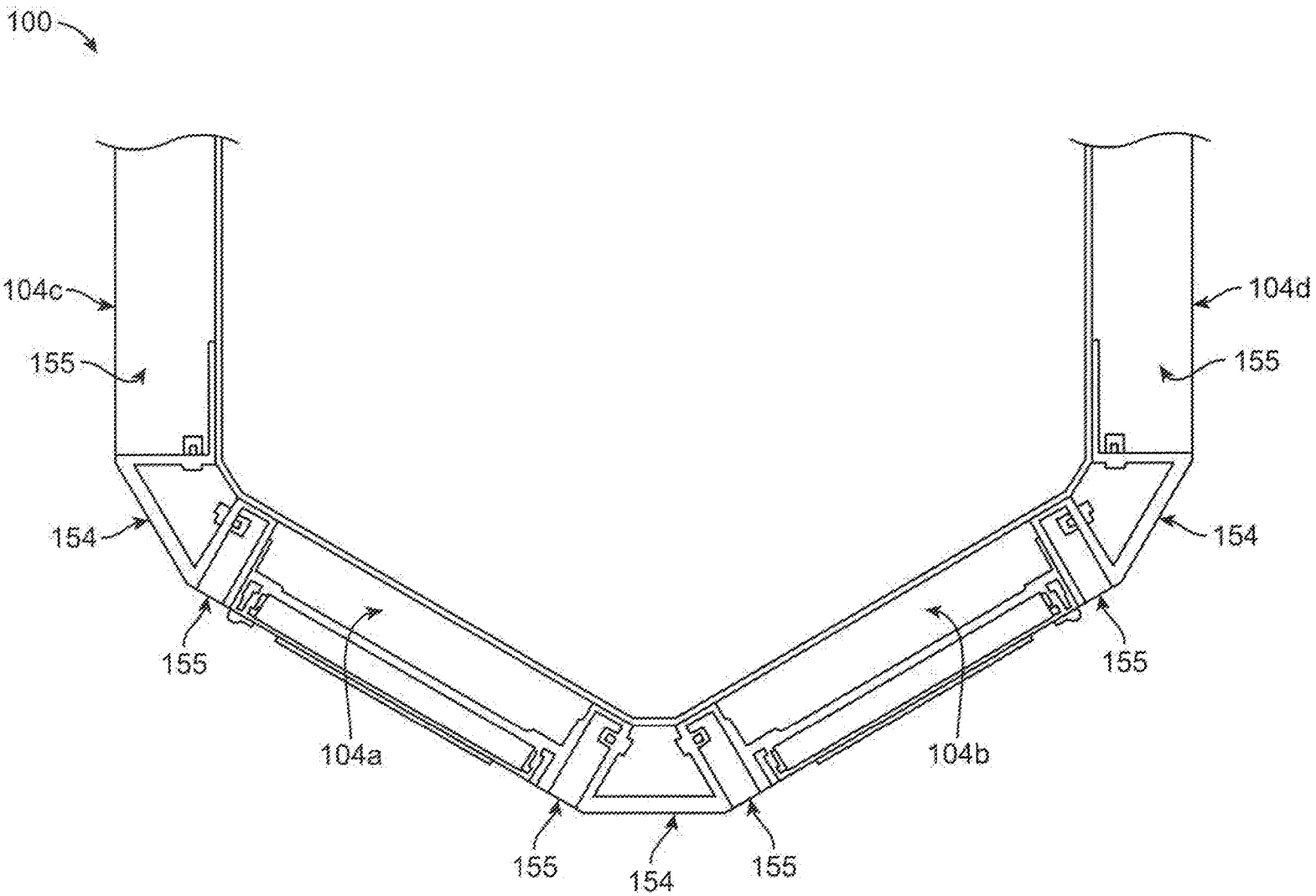
FIG. 7 illustrates the pocket connectors in use to construct the pentagon shaped tower.

FIG. 7 illustrates the pocket connectors 154 in use to construct the pentagon shaped tower 100. In particular, FIG. 7 illustrates a portion of a cross-section of the tower 100 showing the pocket connectors 154 holding the panels 104 in place. As mentioned previously, the front of the guard tower 100 has a two-sided shape that typically extends beyond the perimeter wall 102. FIG. 7 illustrates this portion of the guard tower 100 wherein the first panel 104*a* is connected to the second panel 104*b* by a pocket connector 154. Likewise, the first panel 104*a* is connected to the third panel 104*c* by a pocket connector 154, and the second panel 104*b* is connected to the fourth panel 104*d* by a pocket connector 154. Also shown are the edge sides 155 of the steel frames therebetween. The steel edge 155 may be a part of the panels 104*a* and 104*b*, and in embodiments of the invention, not a separate piece.

Second Story

In some embodiments, the guard tower 100 was designed to have two floors. In some embodiments, the second floor is formed by a pentagonal steel plate deck with a hinged floor-hatch opening. In some embodiments, the steel deck assembly is installed slightly above the tower mid-height (10 ft 9⅝ in.) and fit flush against the five upright wall panels.

Roof

In some embodiments, two prefabricated composite steel/concrete panels make up the tower's roof 126. In some embodiments, a front roof panel has a pentagonal shape formed by four welded W-shaped beams and a 6-in.-tall by ⅜-in.-thick steel flat bar. And, a back roof panel has a rectangular shape formed by three welded W-shaped beams and a 6-in.-tall by ⅜-in.-thick steel flat bar. The front roof panel and the back roof panel are filled with concrete in a manner similar to the wall panels 104. Typically, the roof panels are bolted to the top of the side and rear tower wall panels through the W-shaped beam bottom flanges.

Foundation

In some embodiments, the tower foundation is a slab on or below grade. In some embodiments, a 20-in.-tall, five-sided curb provides a bearing surface for the tower wall panels 104. Typically, any gap between the erected panels 104 and the curb is grouted with non-shrink grout for the top 2 to 3 in. The remaining void is then filled with dry graded sand. If no sand is available, the entire curb height can be grouted.

Methods of Construction

As previously noted, the guard tower 100 is intended for off-site fabrication of all steel components. The tower is shipped to its intended location, filled with concrete, and assembled on site. However, if the supply of on-site labor or the quality of local concrete at the tower's intended location is an issue of concern, the concrete panels can be precast and shipped.

Figure 8A:
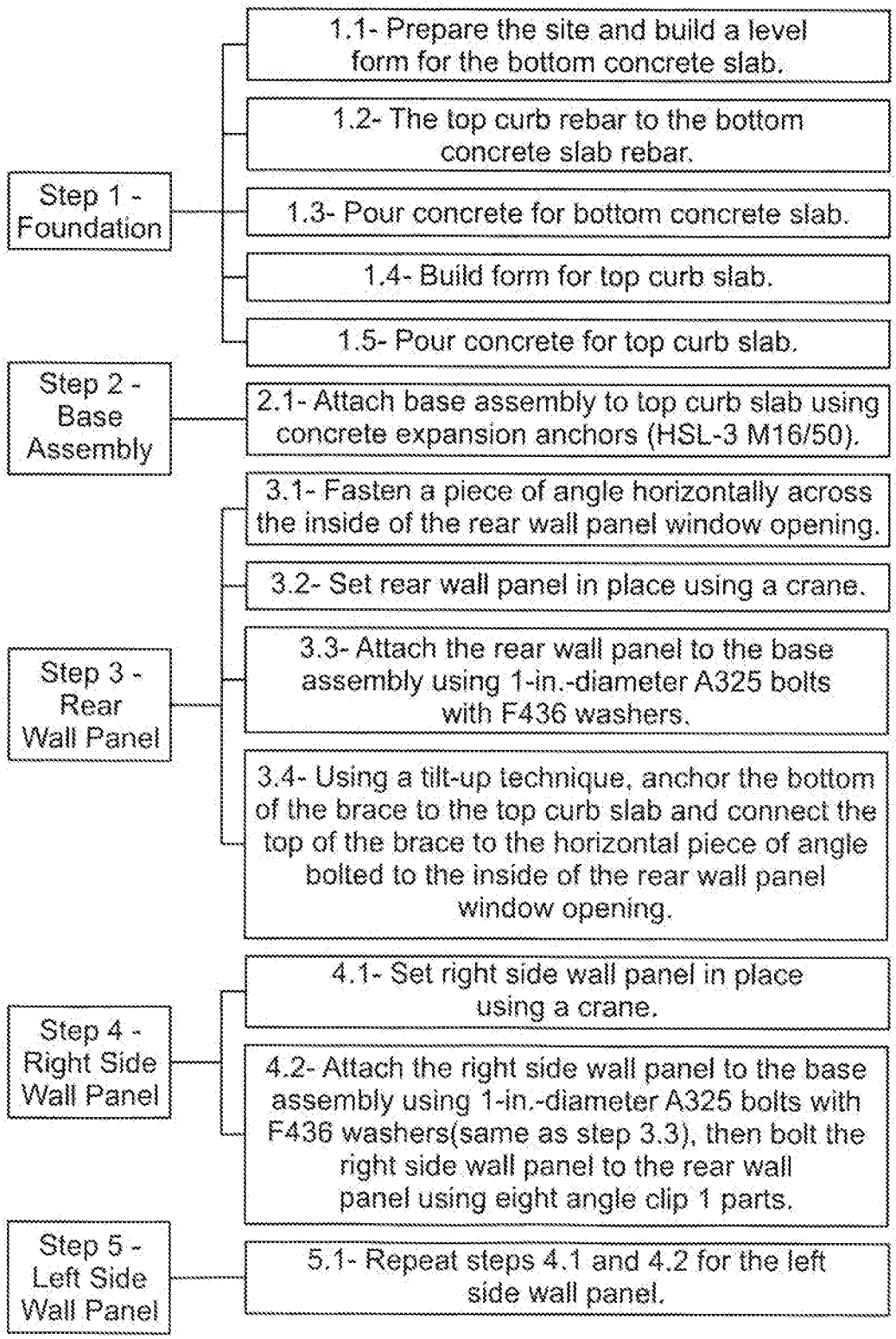
FIGS. 8A-8B provide a quick reference assembly flowchart of a method of constructing an embodiment of a guard tower.
Figure 8B:
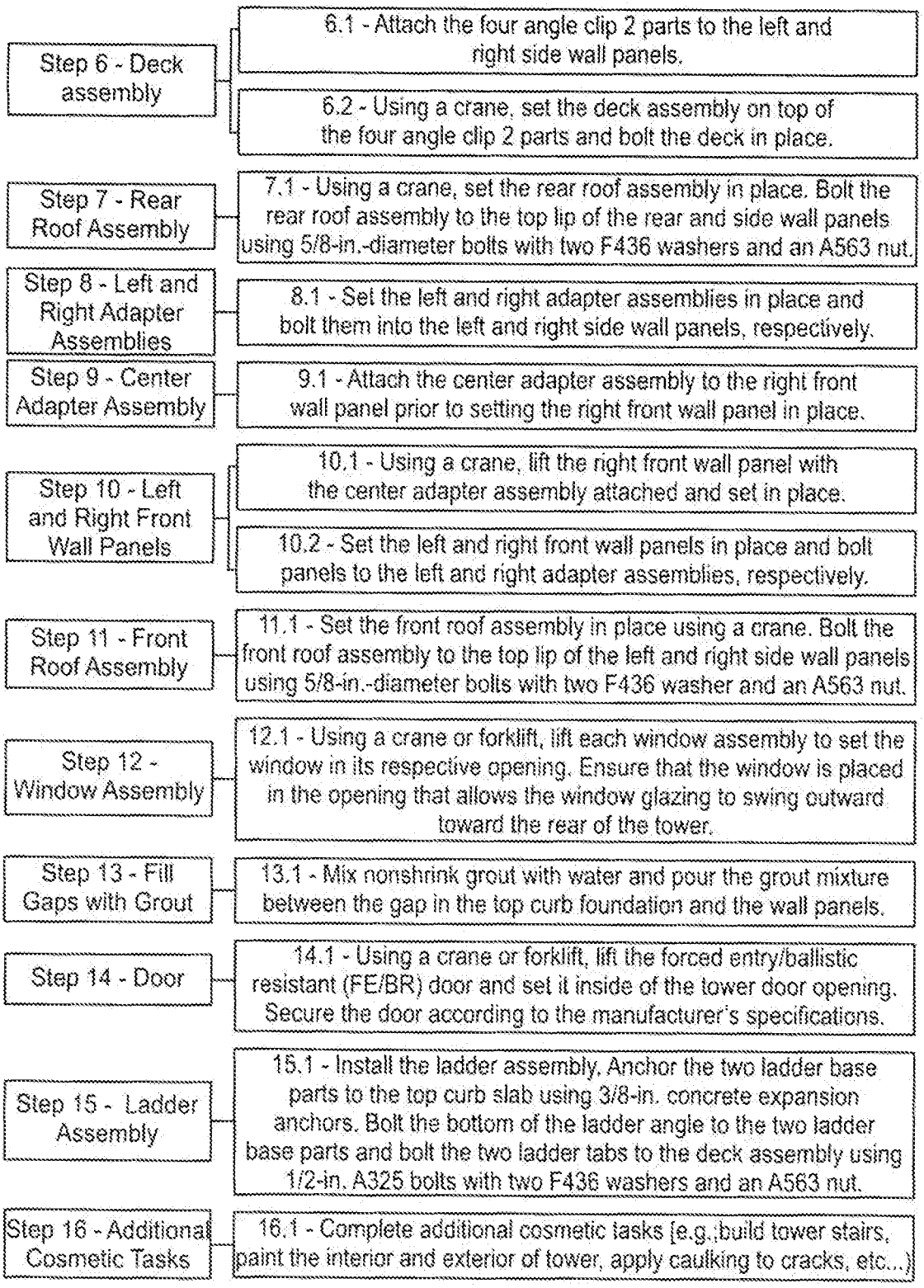

FIGS. 8A-8B provide a quick reference assembly flowchart of a method of constructing an embodiment of a guard tower 100.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A modular enclosed structure comprising: a plurality of panels, each panel comprising a rectangular metal frame fillable with concrete wherein the metal frame has at least two vertical edge sides; a plurality of metal pocket connectors, each pocket connector having an external side disposed between two connection sides and wherein each pocket connector is configured to be positioned between each of the plurality of panels so that each connection side interfaces with one of the vertical edge sides so as to form the enclosed structure: and a plurality of fasteners wherein each fastener is configured to fasten the plurality of pocket connectors to the plurality of panels along the vertical edge sides in a metal to metal connection, wherein the plurality of panels comprises five panels and the plurality of metal pocket connectors comprises five metal pocket connections, wherein the five panels and five metal pocket connectors are configured to be arranged in a cross-sectional pentagon shape to form the enclosed structure.

2. The modular enclosed structure according to claim 1, wherein the enclosed structure is configured to be positioned along a wall so that a two-sided portion of the pentagon shape extends beyond the wall forming a front of the enclosed structure.

3. The modular enclosed structure according to claim 2, wherein panels of the two-sided portion of the pentagon shape each include a window positioned so as to provide a line of sight along the wall.

4. The modular enclosed structure according to claim 3, wherein each window is positioned at least 8 feet above the ground.

5. The modular enclosed structure according to claim 1, wherein each of the plurality of panels is configured to fit into a standard 20-ft ISO container.

6. The modular enclosed structure according to claim 1, wherein each of the plurality of panels has a thickness of up to 10 inches.

7. The modular enclosed structure according to claim 1, wherein each metal frame comprises steel reinforcing bars positioned in a grid pattern.

8. The modular enclosed structure according to claim 1, further comprising a steel deck assembly configured to be positioned within the enclosed structure so as to create a second floor.

9. A method of constructing an enclosed structure comprising:

erecting a plurality of panels wherein each panel comprises a rectangular metal frame having at least two vertical edge sides and wherein the metal frame is filled with concrete, positioning a plurality of metal pocket connectors so that each metal pocket connector is disposed between each panel of the plurality of panels, wherein each pocket connector has an external side disposed between two connection sides and wherein positioning comprises arranging each metal pocket connector so that each of the connection sides interfaces with one of the vertical sides:

fastening each connection side with one of the vertical sides in a metal to metal connection so that the plurality of panels and plurality of metal pocket connectors forms the enclosed structure, wherein the enclosed structure has a pentagon shape, and further comprising positioning the enclosed structure along a wall so that a two-sided portion of the pentagon shape extends beyond the wall forming a front of the enclosed structure.

10. The method according to claim 9, further comprising building a foundation having a pentagon shape prior to erecting the plurality of panels.

11. The method according to claim 10, further comprising constructing a base assembly and attaching the base assembly to the foundation.

12. The method according to claim 11, further comprising fastening each of the plurality of panels to the base assembly.

13. The method according to claim 9, further comprising positioning a steel deck assembly within the enclosed structure so as to create a second floor.

14. The method according to claim 9, further comprising filling each metal frame with the concrete prior to erecting the plurality of panels.

15. The method according to claim 9, further comprising assembling each metal frame prior to filling each metal frame with the concrete.

16. The method according to claim 14, further comprising shipping each metal frame in a standard 20-ft ISO container prior to filling each metal frame with the concrete.

* * * * *